US009186895B2

(12) United States Patent
Aoki

(10) Patent No.: US 9,186,895 B2
(45) Date of Patent: Nov. 17, 2015

(54) LIQUID DROPLET DISCHARGE HEAD, LIQUID DROPLET DISCHARGE APPARATUS INCLUDING THE SAME, AND INK-JET RECORDING APPARATUS AS THE LIQUID DROPLET DISCHARGE APPARATUS

(71) Applicant: Kazunari Aoki, Kanagawa (JP)

(72) Inventor: Kazunari Aoki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 128 days.

(21) Appl. No.: 14/039,257

(22) Filed: Sep. 27, 2013

(65) Prior Publication Data

US 2014/0098162 A1 Apr. 10, 2014

(30) Foreign Application Priority Data

Oct. 10, 2012 (JP) ..... 2012-225182

(51) Int. Cl.
*B41J 2/14* (2006.01)
*B41J 2/16* (2006.01)

(52) U.S. Cl.
CPC ..... *B41J 2/1433* (2013.01); *B41J 2/14274* (2013.01); *B41J 2/162* (2013.01); *B41J 2/1612* (2013.01); *B41J 2/1625* (2013.01); *B41J 2/1626* (2013.01); *B41J 2/1632* (2013.01)

(58) Field of Classification Search
CPC ..... B41J 2/1632; B41J 2/2135; B41J 2/1433; B41J 2/0453; B41J 2/1621; B41J 2/1634; B41J 2/162
USPC ..... 347/40, 47
See application file for complete search history.

(56) References Cited

U.S. PATENT DOCUMENTS

| | | | | |
|---|---|---|---|---|
| 5,988,786 | A | 11/1999 | Waller et al. | |
| 6,431,682 | B1 | 8/2002 | Osada et al. | |
| 6,745,467 | B1 * | 6/2004 | Terai et al. | 29/890.1 |
| 2002/0067395 | A1 * | 6/2002 | Horii et al. | 347/47 |
| 2004/0107759 | A1 * | 6/2004 | Akahane et al. | 72/403 |
| 2006/0055732 | A1 * | 3/2006 | Ogawa et al. | 347/54 |
| 2007/0279453 | A1 * | 12/2007 | De Kegelaer | 347/33 |
| 2008/0100664 | A1 * | 5/2008 | Owaki | 347/45 |
| 2010/0026752 | A1 * | 2/2010 | Kobayashi et al. | 347/20 |
| 2010/0149264 | A1 * | 6/2010 | Takimoto et al. | 347/47 |
| 2010/0194827 | A1 * | 8/2010 | Ogawa et al. | 347/71 |
| 2011/0181667 | A1 * | 7/2011 | Sagara et al. | 347/68 |

FOREIGN PATENT DOCUMENTS

| | | |
|---|---|---|
| JP | 11-320888 | 11/1999 |
| JP | 2003-341069 | 12/2003 |
| JP | 2009-179032 | 8/2009 |

OTHER PUBLICATIONS

European Search Report dated Jan. 15, 2014 in corresponding European patent application No. 13 18 5206.3.

* cited by examiner

*Primary Examiner* — Matthew Luu
*Assistant Examiner* — Patrick King
(74) *Attorney, Agent, or Firm* — Cooper & Dunham LLP

(57) ABSTRACT

A liquid droplet discharge head includes an orifice plate that has a nozzle hole row in which a plurality of nozzle holes is formed in a row by press working. Liquid droplets are discharged to a to-be-landed-on member from the nozzle holes and land on the to-be-landed-on member, and a plurality of dummy pressed points for making uniform opening directions of the nozzle holes is formed on both of end sides of the nozzle hole row in the orifice plate.

6 Claims, 5 Drawing Sheets

Prior Art

LIQUID DROPLET DISCHARGE HEAD, LIQUID DROPLET DISCHARGE APPARATUS INCLUDING THE SAME, AND INK-JET RECORDING APPARATUS AS THE LIQUID DROPLET DISCHARGE APPARATUS

BACKGROUND OF THE INVENTION

1. Field of the Invention

The present invention relates to a liquid droplet discharge head such as an ink-jet recording head used in an ink-jet recording apparatus, and, in particular, to a configuration of an orifice plate to be used in the liquid droplet discharge head.

2. Description of the Related Art

High quality in an image to be output is demanded for printing by an ink-jet recording head not only for consumer use but also for industrial use. Further, on-demand printing is requested also in a field of printing for a large signboard, a poster or the like, and thus, on-demand-type ink-jet recording apparatuses are used on many occasions.

For these ink-jet recording apparatuses, miniaturization of the apparatuses and cost reduction are required. As for the ink-jet recording apparatuses, miniaturization of the ink-jet recording heads by increasing the nozzle mounding density, i.e., reducing the nozzle hole intervals in the nozzle hole rows is required. Also, miniaturization of the ink-jet recording heads by reducing the distances among the plurality of nozzle hole rows is required. Further, an increase in the number of nozzles is also required.

Furthermore, recently, the number of cases of using the ink-jet recording heads discharging special solutions for forming liquid crystal displays, forming wiring patterns or the like has increased. For the purpose of such patterning, such an orifice plate is required that nozzle holes are formed with high accuracy, since it is necessary to reduce variations in positions at which liquid droplets discharged by the liquid droplet discharge head land on a to-be-landed-on member.

SUMMARY OF THE INVENTION

According to one embodiment of the present invention, a liquid droplet discharge head includes an orifice plate that has a nozzle hole row in which a plurality of nozzle holes is formed in a row by press working. Liquid droplets are discharged to a to-be-landed-on member from the nozzle holes and land on the to-be-landed-on member. In the liquid droplet discharge head, a plurality of dummy pressed points for making uniform opening directions of the nozzle holes is formed on both of end sides of the nozzle hole row in the orifice plate.

Other objects, features and advantages of the present invention will become more apparent from the following detailed description when read in conjunction with the accompanying drawings.

DETAILED DESCRIPTION OF THE EMBODIMENTS

Figure 5:
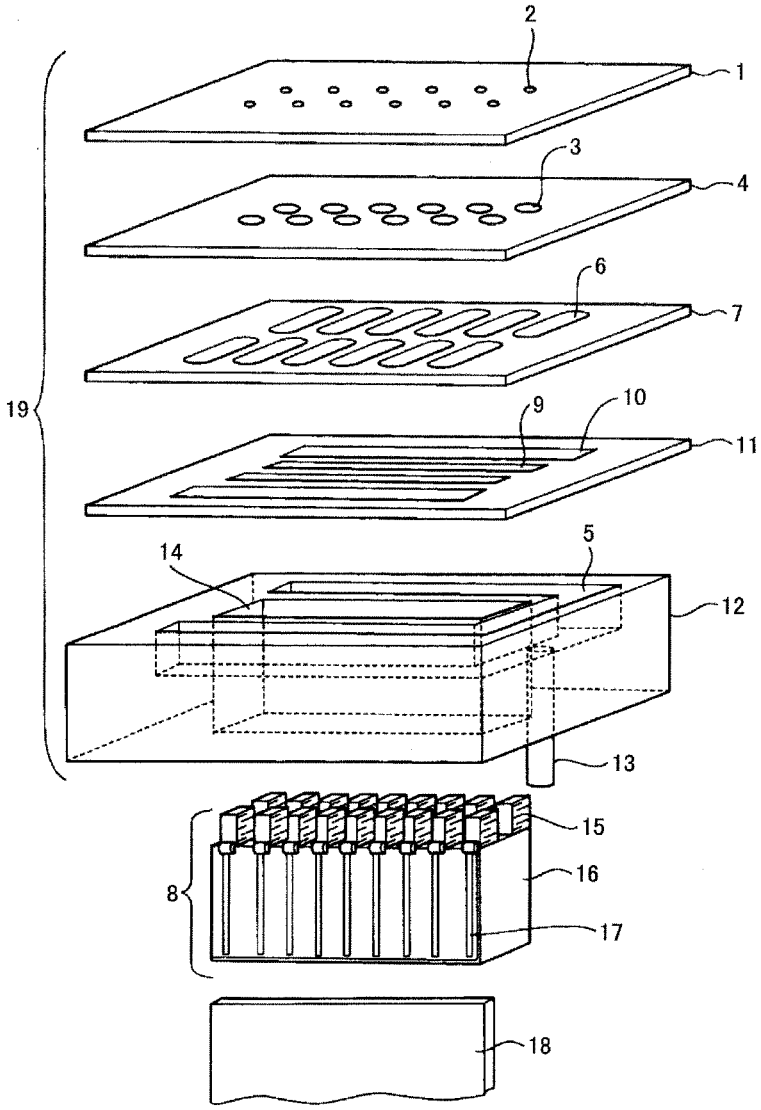
FIG. 5 shows an exploded perspective view of an ink-jet recording head according to the first embodiment.

FIG. 5 shows an exploded perspective view of an ink-jet recording head 40 according to the first embodiment.

In FIG. 5, an orifice plate 1 is shown in which, as shown, many ink nozzle holes 2 that discharge ink droplets are formed in rows. Note that the working accuracy in the nozzle holes 2 has a very large influence on the ink discharge performance of the ink-jet recording head 40. In order to control variations in the working accuracy in the nozzle holes 2 among the many nozzle holes 2 at a satisfactorily low level, high working accuracy is required for forming the orifice plate 1. For this purpose, the orifice plate 1 is formed by precision press working using a stainless steel plate, or the like.

A chamber plate 4 and a restrictor plate 7 are positioned with respect to the orifice plate 1, and are joined to the orifice plate 1. Pressure chambers 3 that correspond to the respective nozzle holes 2 are formed in the pressure chamber plate 4, and restrictors 6 are formed in the restrictor plate 7. The restrictors 6 connect a common ink passage 5 and the pressure chambers 3, and control the flows of the ink into the pressure chambers 3.

A diaphragm plate 11 has elasticity and includes vibration plates 9 and filters 10. The vibration plates 9 efficiently transmit displacement of piezoelectric elements (pressure generation sources) 8 to the pressure chambers 3. The filters 10 filter out dirt/dust included in the ink that flows from the common ink passage 5 into the restrictors 6. The common ink passage 5 is formed in a housing 12. The diagram plate 11 and the housing 12 are also positioned with respect to and joined to the orifice plate 1 in the same way.

The chamber plate 4, the restrictor plate 7 and the diaphragm plate 11 are formed by an etching process or a nickel electroforming process using stainless steel plates, or the like.

The housing 12 is formed by a cutting process using a stainless material. To the housing 12, an ink introducing pipe 13 is joined for introducing the ink from an ink tank (not shown) into the common ink passage 5. Further, a piezoelectric element storage part 14 is formed in the housing 12 at a predetermined place for holding the piezoelectric elements 8 therein.

The piezoelectric elements 8 include many laminated piezoelectric vibrators 15 and a nonconductive attaching member 16 having a conductive pattern part, and the piezoelectric vibrators 15 are attached to the attaching member 16. The laminated piezoelectric vibrators 15 that are divided are arranged to correspond to the respective pressure chambers 3. Also external electrodes 17 including individual electrodes and a common electrode for transmitting independent electric signals from a driver IC (not shown(to the laminated piezoelectric vibrators 15 are formed in the attaching member 16.

To the side surface of the attaching member 16 on which the external electrodes 17 are formed, a transit interconnection substrate 18 (made of a FPC cable) on which the driver IC is mounted is attached and connected. The transit interconnection substrate 18 is connected with a host apparatus (not shown).

An ink passage unit 19 includes the orifice plate 1, the chamber plate 4, the restrictor plate 7, the diaphragm plate 11 and the housing 12. Further, a head part body includes the ink passage unit 19, the piezoelectric elements 8 and the transit interconnection substrate 18.

Electric signals are provided to the piezoelectric elements 8 via the driver IC on the transit interconnection substrate 18 and the external electrodes 17, and thereby, distortion occurs in the laminated piezoelectric vibrators 15. As a result, the vibration plates 9 are deformed, the internal pressures in the pressure chambers 3 are thus changed, and the ink contained in the pressure chambers 3 is discharged as ink droplets from the nozzle holes 2.

Figure 6:
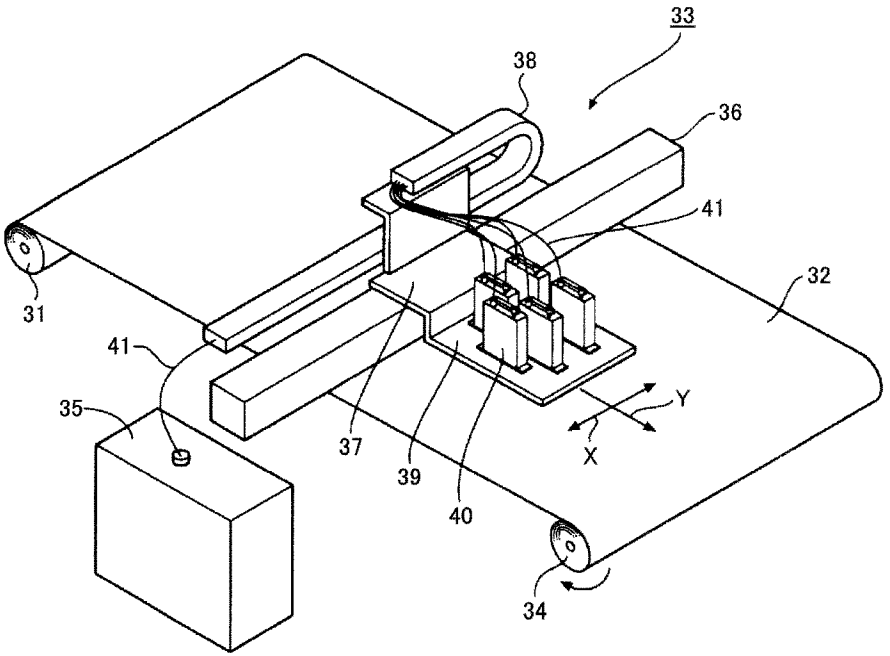
FIG. 6 is a general configuration diagram showing the entire configuration of an ink-jet recording apparatus according to the first embodiment in which ink-jet recording heads are mounted.

FIG. 6 shows a general configuration diagram showing the entire configuration of an ink-jet recording apparatus according to the first embodiment in which the ink-jet recording heads are mounted.

As shown in FIG. 6, a continuous to-be-recorded-on medium (continuous paper sheet) 32 is unwound from a paper supply part 31 at high speed, a desired image is then printed on the continuous to-be-recorded-on medium 32 at an ink-jet recording part 33, and then, the continuous to-be-recorded-on medium 32 is wound onto and is collected by a paper collecting part 34.

The ink-jet recording part 33 includes an ink tank 35 installed at a body side in the ink-jet recording apparatus; a direct movement guide 36 extending along a width direction (a X-direction) of the to-be-recorded-on medium 32; a carriage 37 reciprocating at high speed along the width directions (X-directions) of the to-be-recorded-on medium 32 along the direct movement guide 36; and a cableveyor (registered trademark) 38.

On a flat part 39 facing the to-be-recorded-on medium 32 in the carriage 37, plural of the ink-jet recording heads 40, as shown in FIG. 6, are individually placed and mounted in a staggered arrangement, in such a manner that the orifice plate 1 is placed at the bottom in each of the ink-jet recording heads 40. As shown in FIG. 6, flexible ink supply tubes 41 are provided to connect between the ink tank 35 and the cableveyor 38, and between the cableveyor 38 and the respective ink-jet recording heads 40. In this configuration, the to-be-recorded-on medium 32 is conveyed in the direction Y shown.

Note that, for example, Japanese Laid-Open Patent Application No. 11-320888 and Japanese Laid-Open Patent Application No. 2003-341069 relate to orifice plates such as the orifice plate 1 to be used in such as the ink-jet recording head 40.

For the sake of convenience, a problem in the related art will now be described using FIGS. 7 and 8, assuming that the related art has the same configurations as those shown in FIGS. 5 and 6 that have been described above, as those according to the first embodiment.

Figure 7:
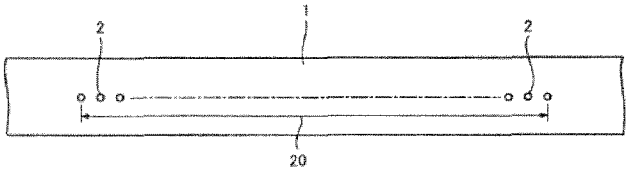
FIG. 7 shows a magnified plan view of a part of an orifice plate according to the related art.

FIG. 7 shows a magnified plan view of a part of an orifice plate 1 according to the related art. As shown, many nozzle holes 2 are formed in a row at predetermined positions, each nozzle hole 2 passing through the orifice plate 1. The nozzle holes 2 are formed in a nozzle hole formation area 20.

Figure 8:
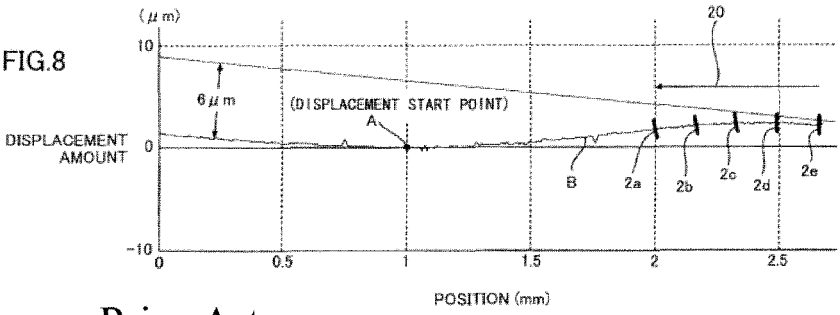
FIG. 8 is a displacement measurement diagram showing a result of measuring displacement at an end of the orifice plate, according to the related art, in which nozzle holes are formed in a row by precision press working.

FIG. 8 is a displacement measurement diagram showing a result of measuring displacement at an end of the orifice plate 1, according to the related art, in which nozzle holes 2 are formed in a row by precision press working. The displacement measurement was carried out using a $NH_3$ laser measurement instrument. The measurement was started at a position distant outward by 2 mm from an outermost one 2*a* of the nozzle holes 2. The measurement intervals are 0.01 mm. The displacement of the orifice plate 1 started at the point A, and the displacement curve B can be obtained from connecting the respective displacement points that were obtained from the measurement. Further, thick line segments 2*a*, 2*b*, . . . , 2*e* indicate the opening directions of the pierced nozzle holes 2 (i.e., the directions along which the respective nozzle holes 2 extend).

As shown in FIG. 8, in the case where the many nozzle holes 2 are formed in a row in the orifice plate 1, the orifice plate 1 is curved to protrude more as the position moves inside more (see the displacement curve B). Then, each of the opening directions of the nozzle holes 2*a*, 2*b* and 2*c* in the thus curved (protruded) area is different from the vertical direction and is oblique with respect to the vertical direction, as shown in FIG. 8. The nozzle holes 2, each of which has the opening direction approximately equal to the vertical direction, are the nozzle hole 2*e* and those (not shown) placed further inside.

In the example of FIG. 8, the nozzle hole 2*a* is away from the displacement start point A only by 1 mm.

Also at the other end of the orifice plate 1, a similar curved part in which the orifice plate 1 was curved to protrude exists, and the opening direction of each of the nozzle holes 2 placed there is oblique with respect to the vertical direction.

Thus, the opening direction of each of the plurality of nozzle holes 2 placed at both of the ends of the row of the nozzle holes 2 is different from the vertical direction and is oblique. As a result, the positions at which ink droplets discharged through these oblique nozzle holes 2 land vary accordingly, and thus, it may be difficult to obtain a high quality image. This is a problem in the related art.

An object of the embodiments is to provide liquid droplet discharge heads in each of which it is possible to solve the problem in the related art. As a result, each of the liquid droplet discharge heads according to the embodiments can discharge liquid droplets in such a manner that the positions at which the liquid droplets thus discharged land on a to-be-landed-on member (to-be-recorded-on medium) do not vary, and it is possible to discharge liquid droplets to cause them to accurately land on the to-be-landed-on member (to-be-recorded-on medium). Thus, it is possible to provide liquid droplet discharge heads each having superior operational reliability, liquid droplet discharge apparatuses including the liquid droplet discharge heads and ink-jet recording apparatuses that are examples of the liquid droplet discharge apparatuses.

Figure 1:
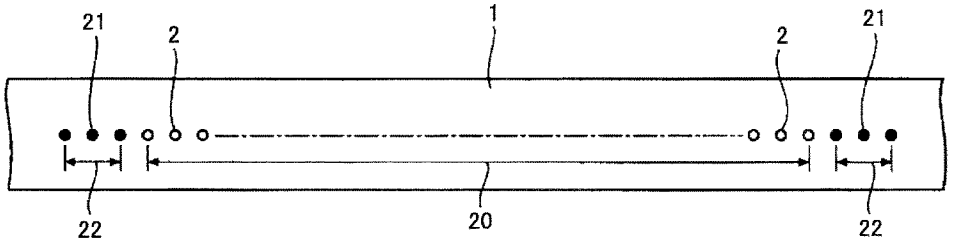
FIG. 1 shows a magnified plan view of a part of an orifice plate according to a first embodiment.
Figure 2:
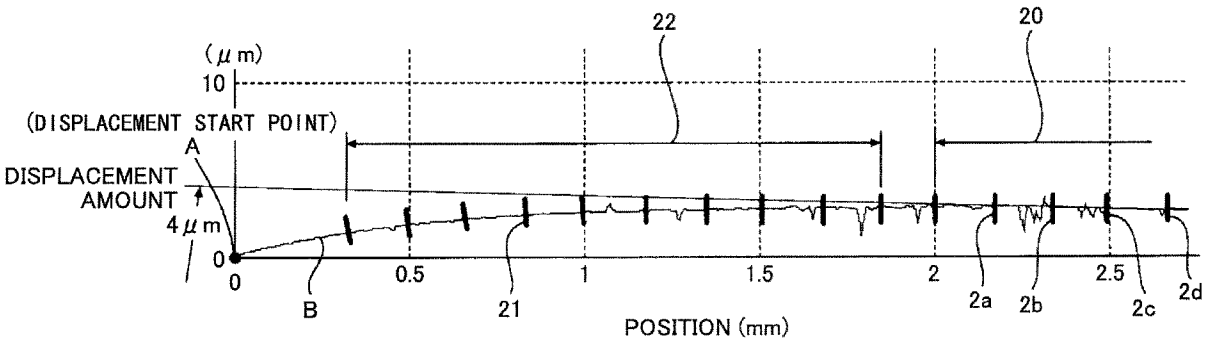
FIG. 2 is a displacement measurement diagram showing a result of measuring displacement at an end of the orifice plate, according to the first embodiment, in which nozzle holes and dummy depressions are formed in a row by precision press working.
Figure 3:
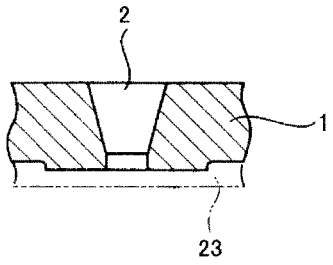
FIG. 3 shows a magnified cross-sectional view of the nozzle hole formed in the orifice plate and the vicinity thereof according to the first embodiment.
Figure 4:
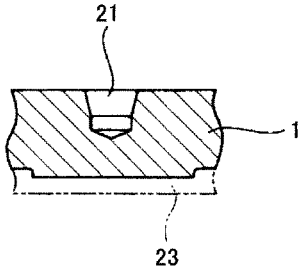
FIG. 4 shows a magnified cross-sectional view of a dummy depression formed in the orifice plate and the vicinity thereof according to the first embodiment.

FIG. 1 shows a magnified plan view of a part of an orifice plate 1 according to the first embodiment. FIG. 2 is a displacement measurement diagram showing a result of measuring displacement at an end of the orifice plate 1, according to the first embodiment, in which nozzle holes 2 and dummy depressions (pressed points) 21 are formed in a row by precision press working. FIG. 3 shows a magnified cross-sectional view of the nozzle hole 2 formed in the orifice plate 1 and the vicinity thereof according to the first embodiment. FIG. 4 shows a magnified cross-sectional view of the dummy depression 21 formed in the orifice plate 1 and the vicinity thereof according to the first embodiment.

As shown in FIG. 1, many of the nozzle holes 2 are formed in a row at predetermined positions on the orifice plate 1.

Thus, the nozzle holes 2 are formed in a nozzle hole formation area 20. Further, as shown in FIG. 1, plural of the dummy depressions 21 (in the first embodiment, as shown in FIG. 2, 10 of the dummy depressions 21 at each end) are formed in respective rows in alignment with the row of the nozzle holes 2 (nozzle hole row) near both of the ends (or on both of the end sides) of the nozzle hole row. As shown in FIG. 1, the dummy depressions 21 are formed in dummy depression formation areas 22.

As the material of the orifice plate 1, a stainless steel plate is used, and the nozzle holes 2 and the dummy depressions 21 are formed by precision press working using a punch and a die that receives the punch. As shown in FIG. 1, the shape viewed from the top of each dummy depression 21 is circular, the same as or similar to that of each nozzle hole 2.

The nozzle holes 2 and the dummy depressions 21 are formed from the same side of the orifice plate 1 (in the first embodiment, from the topside of the orifice plate 1). While the nozzle holes 2 pass through the orifice plate 1 from the top side to the under side as shown in FIG. 3, the dummy depressions 21 extend from the top side of the orifice plate 1 up to an intermediate position in the thickness direction, and thus, are not through holes. In FIG. 1, the nozzle holes 2 are expressed by 0 since they pass through while the dummy depressions 21 are expressed by ● since they do not pass through.

The displacement measurement of the orifice plate 1 shown in FIG. 2 was carried out under the same conditions as those in the displacement measurement of the orifice plate 1 in the related art described above using FIG. 8.

As shown in FIG. 2, at an end of the nozzle hole formation area 20, the dummy depression formation area 22 is defined in which the plurality of dummy depressions 21 is placed. Thick line segments shown in the dummy depression formation area 22 denote the respective opening directions of the dummy depressions 21.

Basically in the same way as that in FIG. 8, the orifice plate 1 according to the first embodiment is curved to protrude more as the position moves inside more (see the displacement curve B in FIG. 2). However, a little inside the thus curved part (precisely, inside the point that is away inside from the displacement start point A by 2 mm), the displacement curve B is approximately level (level part).

Further, the outermost nozzle hole 2*a* in the nozzle hole row is away from the displacement start point A by more than 2 mm on the orifice plate 1, and each of the dummy depressions 21 placed within the dummy depression formation area 22 and not used to discharge ink droplets has the oblique opening direction. In contrast thereto, each of the nozzle holes 2 (2*a*, 2*b*, 2*c* and 2*d*), including the outermost nozzle hole 2*a*, used to discharge ink droplets has the vertical opening direction.

Thus, according to the first embodiment, it is possible to elongate the distance from the displacement start point A to the outermost nozzle hole 2*a* twice in comparison to the related art shown in FIG. 8. As a result, the nozzle hole formation area 20 can be made to fall within the level part that remains between the curved parts at both end parts of the orifice plate 1, and thus, the nozzle holes 2 within the nozzle hole formation area 20 have the vertical opening directions. Note that also the other end of the orifice plate 1 has a displacement measurement result the same as or similar to that shown in FIG. 2.

Thus, each of the nozzle holes in the nozzle hole row that starts at the outermost nozzle hole 2*a* extends vertically. As a result, the positions at which ink droplets discharged through these vertical nozzle holes 2 land do not vary accordingly, and thus, it is possible to obtain a high quality image.

Note that as shown in FIGS. 3 and 4, a water repellent film 23 is formed on the side of the orifice plate 1 facing the to-be-recorded-on medium 32.

According to the first embodiment, it is possible to provide the liquid droplet discharge head by which it is possible to solve the above-mentioned problem in the related art. As a result, the liquid droplet discharge head according to the first embodiment can discharge liquid droplets in such a manner that the positions at which the liquid droplets thus discharged land on a to-be-landed-on member do not vary and it is possible discharge liquid droplets to cause them to accurately land on the to-be-landed-on member. Thus, it is possible to provide the liquid droplet discharge head having superior operational reliability, the liquid droplet discharge apparatus including the liquid droplet discharge head and the ink-jet recording apparatus as an example of the liquid droplet discharge apparatus.

Although the liquid droplet discharge head, the liquid droplet discharge apparatus and the ink-jet recording apparatus have been described above by the first embodiment, the present invention is not limited to the first embodiment, and variations and modifications may be made without departing from the scope of the present invention.

For example, the dummy depressions 21 that do not pass through the orifice plate 1 are used as dummy pressed points as mentioned above according to the first embodiment. However, embodiments of the present invention are not limited thereto. Instead of the dummy depressions 21, "dummy holes" that pass through the orifice plate 1 may be formed as the dummy pressed points in the orifice plate 1 in another embodiment.

However, the outermost nozzles through which ink droplets are discharged are used as position-adjustment reference holes when the ink-jet recording head is mounted in the ink-jet recording apparatus. Therefore, when such dummy holes are used as the dummy pressed points, the position adjustment may be carried out using an improper through holes. For the purpose of avoiding such a problematic situation, the dummy depressions 21 that do not pass through the orifice plate 1 are more preferable.

Further, according to the above-mentioned embodiments, the rows of dummy pressed points are formed in alignment with the nozzle hole row. However, embodiments of the present invention are not limited thereto. For example, instead of the above-mentioned arrangement, the dummy pressed points may be formed, respectively, at positions somewhat away on both sides of and in parallel with the line of the nozzle hole row, in yet another embodiment. In further another embodiment, many dummy pressed points may be formed, in a random manner, near both the ends (or on both end sides) of the nozzle hole row.

Furthermore, in the above-mentioned embodiments, the cases of the ink-jet recording apparatuses have been described. However, embodiments are not limited thereto. The present invention can be applied also to other fields, for example, those of manufacturing display apparatuses such as those using liquid crystals, electroluminescence or the like, manufacturing printed wiring boards on which an ink containing titanium oxide particles is deposited, manufacturing electronic parts/components such as laminated ceramic parts/components or high frequency electronic parts/components manufactured using a high-concentration ink prepared for electronic parts/components which is subject to sedimentation or condensation, and so forth.

The present patent application is based on and claims the benefit of priority of Japanese Priority Application No. 2012-

225182 filed on Oct. 10, 2012, the entire contents of which are hereby incorporated herein by reference.

What is claimed is:

1. A liquid droplet discharge head comprising:

an orifice plate that has a nozzle hole row in which a plurality of nozzle holes is formed in a row by press working, wherein liquid droplets are discharged to a to-be-landed-on member from the nozzle holes and land on the to-be-landed-on member, and plural dummy pressed points for making uniform opening directions of the nozzle holes are formed in the same orifice plate in which the nozzle hole row is formed, the dummy pressed points being formed outside an extent of the nozzle hole row in a direction in which the nozzle hole row extends and outside both ends of the nozzle hole row in the direction in which the nozzle hole row extends, wherein the dummy pressed points are dummy depressions in the orifice plate that do not pass through the orifice plate from a top side to an under side, and as a result of the dummy pressed points being formed in the orifice plate on both of the end sides of the nozzle hole row by press working, respective curved parts are formed at both of end parts, and a level part remains between the curved parts, and all of the nozzle holes are formed within the level part, and the dummy pressed points are formed in the curved parts, positioned outside the extent of the nozzle hole row, in the direction in which the nozzle hole row extends.

2. The liquid droplet discharge head as claimed in claim 1, wherein the nozzle holes and the dummy pressed points are formed from the same side of the orifice plate.

3. The liquid droplet discharge head as claimed in claim 1, wherein the dummy pressed points are formed in rows that extend in the same direction as that of the nozzle hole row.

4. The liquid droplet discharge head as claimed in claim 3, wherein the rows of the dummy pressed points are in alignment with the nozzle hole row.

5. A liquid droplet discharge apparatus, comprising:

the liquid droplet discharge head claimed in claim 1.

6. An ink-jet recording apparatus as the liquid droplet discharge apparatus claimed in claim 5, comprising:

an ink-jet recording head as the liquid droplet discharge head including the orifice plate that has the nozzle hole row including the plurality of nozzle holes, wherein ink droplets as the liquid droplets are discharged to a to-be-recorded-on medium as the to-be-landed-on member from the nozzle holes and land on the to-be-recorded-on medium.

* * * * *